United States Patent [19]

Giebmanns

[11] Patent Number: 4,587,767

[45] Date of Patent: May 13, 1986

[54] APPARATUS FOR GRINDING

[75] Inventor: Karl Giebmanns, Berlin, Fed. Rep. of Germany

[73] Assignee: Buderus Aktiengesellshaft, Wetzlar, Fed. Rep. of Germany

[21] Appl. No.: 304,079

[22] Filed: Sep. 21, 1981 (Under 37 CFR 1.47)

[30] Foreign Application Priority Data

Sep. 23, 1980 [DE] Fed. Rep. of Germany ..... 3036153

[51] Int. Cl.[4] ..... B24B 19/08

[52] U.S. Cl. ..... 51/101 R; 51/105 R; 51/219 PC; 51/97 NC

[58] Field of Search ..... 51/95 R, 95 WH, 97 R, 51/97 NC, 101 R, 105 R, 219 R, 219 PC, 165.73

[56] References Cited

U.S. PATENT DOCUMENTS

| | | | |
|---|---|---|---|
| 2,553,831 | 5/1951 | Musyl | 51/101 R |
| 2,900,767 | 8/1959 | Voller | 51/165.73 |
| 3,209,493 | 10/1965 | Houser | 51/219 R X |
| 3,731,434 | 5/1973 | Karwinski | 51/105 R X |
| 3,867,793 | 2/1975 | Junker | 51/97 R |
| 4,261,142 | 4/1981 | Nixon et al. | 51/219 PC X |

FOREIGN PATENT DOCUMENTS

| | | | |
|---|---|---|---|
| 1502399 | 8/1969 | Fed. Rep. of Germany | 51/219 R |
| 2209809 | 9/1979 | Fed. Rep. of Germany | . |

*Primary Examiner*—Robert P. Olszewski
*Attorney, Agent, or Firm*—Max Fogiel

[57] ABSTRACT

An arrangement for relief grinding and polygonal grinding on a grinding machine has a device for moving the workpiece spindle and workpiece towards the grinding disk linearly of the pivotable operating lever.

10 Claims, 2 Drawing Figures

APPARATUS FOR GRINDING

BACKGROUND OF THE INVENTION

The present invention relates generally to an apparatus for grinding.

More particularly, the invention relates to an apparatus for relief grinding and polygonal grinding on grinding machines.

Apparatus of this type is used for grinding drills for thread-cutting purposes but can be generally used for grinding of drills.

A device of the type in question is already known from German Pat. No. 2,209,809. In this device, the lever is fixedly connected to the mounting body of the workpiece spindle shaft and its longitudinal axis extends exactly through the pivot axis of the mounting body and the axis of the spindle shaft is arranged at a small lever distance therefrom. The lever distance can be adjusted by eccentric journalling of the spindle shaft.

In this known device, given vertical spacing of the spindle shaft from the pivot axis of the mounting body, when a pivoting of the lever is effected by means of the cam guide provided for this purpose, a movement of the spindle shaft and thus of the workpiece against the grinding disk is effected which in effect causes the workpiece to oscillate parallel to the longitudinal axis of the lever. If the axis of the grinding disk is located on the longitudinal axis of the lever and a pivoting movement of the lever is effected, then only a movement of the grinding spindle and thus of the workpiece normal to the longitudinal axis of the lever is effected, which means that no relief grinding is possible. In all intermediate positions of the axis of the spindle shaft relative to the longitudinal axis of the lever, a combined movement of the workpiece towards the grinding disk is effected, which is composed of a component of movement in longitudinal direction of the lever and a component of movement transversely to the longitudinal axis of the lever. However, a component of movement transversely to the longitudinal axis of the movement is disadvantageous for relief grinding and polygonal grinding, particularly of tap-type drills, because it impermissibly changes the dimensions of the drill.

SUMMARY OF THE INVENTION

Accordingly, it is a general object of the invention to overcome the disadvantages of the prior art.

A more particular object of the invention is to provide an improvement in a device for relief grinding and polygonal grinding of grinding machines of the type in question, in which in all intermediate positions between the zero relief grinding position and the maximum position, relief grinding movements are carried out only in longitudinal direction of the lever.

Another object of the invention is to provide such an improvement in which the various positions can be most precisely adjustable.

In pursuance of these objects, and of still others which will become apparent hereafter, one feature of the invention resides, in an apparatus for relief grinding and polygonal grinding on grinding machines having a grinding disk and a workpiece spindle axis paralleling the grinding disk axis, and an articulated lever mounted on a journaled body, in a combination comprising a cam for controlling oscillating engagement of a workpiece with the grinding disk, and means for converting an articulated movement of the lever into a linear movement of the lever lengthwise of the longitudinal axis thereof, the lever engaging the journal body at a predetermined distance from the journal body pivot axis.

By changing the tilting movement of the lever to a linear movement lengthwise of the longitudinal axis of the lever by means of a shifting device the advantage is obtained that the lever, which engages the journal body at a spacing from the pivot axis, performs exclusively relief grinding movements in direction of its longitudinal axis towards and upon the spindle shaft and thus upon the workpiece which comes in engagement with the grinding disk. The shifting direction is formed of two skewly adjustable glide surface elements, of which one is supported against the housing and the other is mounted at the free end of the lever. The adjusting angle thus offers a measure for the relief grinding movement of the lever in the direction of its longitudinal axis. The glide surface elements are advantageously formed of the two halves of a cylinder member which is split along its axis and one half of which is connected to the free end of the lever while the other half is movably adjustable relative to the housing, both in journal bearings. The skew-directed glide surface extends under an acute angle to the normal through the longitudinal axis of the lever. In the rest position, i.e. during carrying-out a relief grinding movement of the value zero, the glide surface plane is parallel to the plane which passes through the axes of the spindle shaft and of the pivot bearing of the mounting body. Advantageously, the housing-connected glide surface element is pivotable by means of a drive, in order to be able to adjust the relief grinding movement from a zero value to a maximum value.

It is particularly advantageous if the lever has inserted into it a measuring and heating element provided with a control unit, in order to be able to supervise the length of the lever and the position of the longitudinal center axis of the lever. The length of the lever is supervised via its temperature, and by heating the heating element respectively by effecting cooling an influence can be exerted upon the length of the lever and thus upon the diameter of the workpiece being worked. The position of the longitudinal center axis of the lever is supervised by a measuring element in form of an angular position indicator. Furthermore, it is preferred if the pivot axis of the mounting body is formed by a torsion shaft. This eliminates the phenomenon known from other oscillating pivot bearings, namely of the working-in of the two end positions into the pivot axis.

The invention will hereafter be described with reference to exemplary embodiments shown in the drawing. It should be understood, however, that these are by way of example only and should not be considered limiting in any sense on the scope of the appended claims.

DESCRIPTION OF PREFERRED EMBODIMENTS

Figure 1:
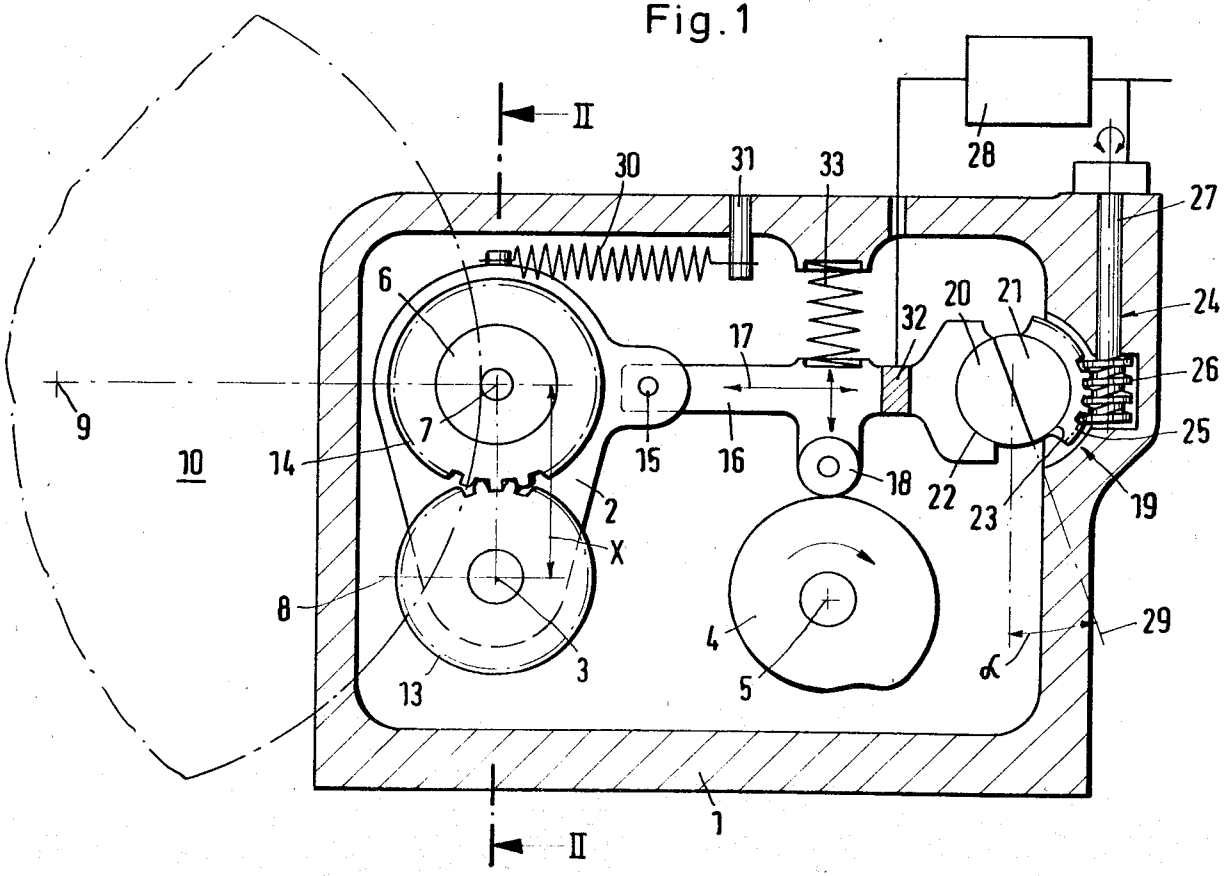
FIG. 1 is a cross-sectional view through an arrangement according to the present invention, in a plane parallel to the driving disk.
Figure 2:
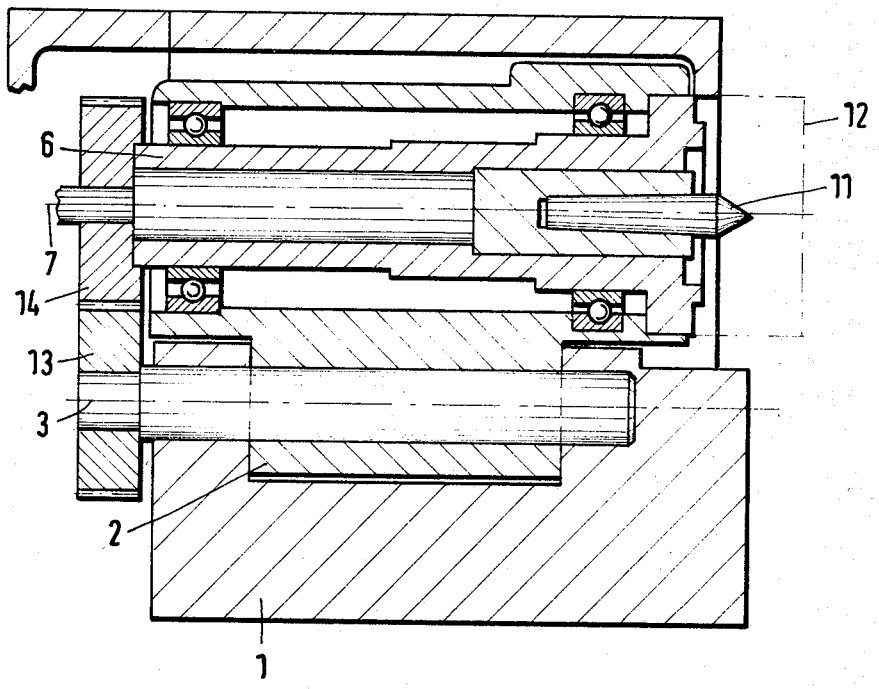
FIG. 2 is a section taken on line II—II of FIG. 1.

Referring now to the drawing it will be seen that the arrangement for relief grinding and polygonal grinding on grinding machines has a housing 1 in which a journal body 2 is pivotable about a torsion shaft 3 and a cam shaft 5 which carries a cam 4. Mounted so as to be turnable about its axis 7 in the journal body 2 is a workpiece spindle shaft 6 which is spaced by the distance X from the axis of the torsion shaft 3. The axis 7 of the spindle shaft 6 extends parallel to the axis 9 of a grinding disk 10 which is used for grinding a workpiece mounted on the spindle shaft 6, particularly a tap-type drill. For this purpose, centers 11 or clamping jaws 12 can be used which are connectable to the free end of the workpiece spindle shaft 6.

Mounted on the torsion shaft 3 is a drive gear 13 which can be driven by a not-illustrated motor and which meshes with an output drive gear 14 and is mounted on the axis 7 of the spindle shaft 6. This effects rotation of the spindle shaft 6 independently of any possible floating movement of the journal body 2 together with the spindle shaft 6 about the pivot axis 8 of the journal body 2.

A lever 16 is mounted on the journal body 2 at the pivot 15 and the longitudinal axis 17 which essentially extends normal to the connecting line between the axis 3 of the body 2 and the spindle shaft axis 7. The lever 16 carries on its underside a cam follower roller 18 which is in engagement with the cam arrangement 4, 5 and at its other side it has a spring 33 which engages the housing 1 and presses the lever 16—which is pivotably journalled about its pivot 15—permanently against the cam arrangement 4, 5.

The purpose of the arrangement described thus far is to convert a pivot movement of the lever 16 by means of a sliding arrangement 19 into a linear movement along the longitudinal axis 17 of the lever 16. The latter engages at a distance X from the pivot axis 3 on the journal body 2.

The sliding arrangement 19 is composed of two slide surface elements 20, 21 which are securely adjustable and of which one element 20 is arranged within a journal bearing 22 and the free end of the lever 16; the other element 21 is secured at the housing 1 by means of a further journal bearing 23. This latter is adjustable by means of a drive 24 which is composed of a worm wheel 25 provided on the journal bearing 23 and a worm 26 which is turnably journalled in the housing 1 on a shaft 27 and can be turned from the exterior via control unit 28. The two slide surface elements 20 and 21 are composed of a cylindrical member which is split along its axis into two halves. The glide plane 29 extends normal to the longitudinal axis 17 of the lever 16 if a relief grinding operation of zero value is to be carried out. In this case the glide surface plane 29 extends parallel to the plane which passes through the axes 3 and 7. If a relief grinding of a different magnitude is to be carried out, then the glide surface plane 29 is inclined under an acute angle $\alpha$ with reference to the normal which passes through the longitudinal axis 17 of the lever 16, as shown in FIG. 1.

The two glide surface elements 20, 21 are pressed together by means of a spring 30 which is located between the upper end of the support body 2 and a pin 31 connected to the housing 1.

The device hereinbefore described converts a pivotable movement imposed via the cam follower roller upon the lever 16 by the cam arrangement 4, 5 into a linear movement of the lever 16, and the glide surface element 20 slides along the glide surface element 21 which is set at the angle $\alpha$. Hereby, a relief grinding of the workpiece engaged with the grinding disk 10, particularly of a tap-type drill, is made possible which consists exclusively of a movement in direction of the longitudinal axis of the lever 16, the lever arm of which corresponds to the distance between the axes 3 and 7. A change in the size of the relief grinding is possible by changing the angle $\alpha$. A movement of the angular position shown in FIG. 1 in clockwise direction decreases the degree of relief grinding, movement in counterclockwise direction increases the degree of relief grinding.

Arranged within the lever 16 is a measuring and heating elemeht 32 which is connected with the control unit 28 for supervising the length of the lever 16 and the position of the longitudinal center axis 17 of the lever 16. Thus, the measuring and heating element 32 can influence the diameter of the workpiece during its working by the grinding disk 10. For example, if at an operating temperature of 60° C. the lever has a certain length, then this can be continuously and very precisely increased in the desired manner by heating the element 32, which may for example consist only of a heating spiral or the like. Longitudinal measurement can be effected by means of tensile measuring strips (tensiometers). The position of the longitudinal central axis 17 of the lever 16 can be determined by an angular position indicator. This can make it possible to obtain a precise setting within the $\mu$-range.

What is claimed is:

1. An arrangement for relief grinding and polygonal grinding on grinding machines, comprising: a machine housing; a grinding disk on said machine housing for grinding a workpiece, said grinding disk having a disk axis; a workpiece spindle shaft with axis parallel to said grinding disk axis, said workpiece spindle shaft mounting the workpiece; a journal body, with a pivot axis in said housing, mounting the spindle shaft and an articulated lever mounted on said journal body, said lever having a free end; cam means actuating said lever to generate an articulated movement for controlling oscillating engagement of the workpiece with said grinding disk; means for converting said articulated movement of said lever into a linear movement of the lever lengthwise of the longitudinal axis thereof, said lever engaging said journal body at a predetermined distance from said journal body pivot axis, said means for converting said articulated movement of said lever into a linear movement of the lever comprising sliding means having two mutually adjustable glideface elements, one of said elements being mounted on said machine housing and the other one of said elements being mounted on the free end of said lever.

2. An arrangement as defined in claim 1, wherein said elements comprise two halves of a lengthwise split cylindrical member, each of said elements being supported in a bearing shell on said housing and said lever, respectively.

3. An arrangement as defined in claim 1, and further comprising means for pivoting said one element about an axis thereof.

4. An arrangement as defined in claim 1, and further comprising a tension spring pulling said two elements into mutual engagement.

5. An arrangement as defined in claim 4, wherein said tension spring reacts between said housing and said journal body.

6. An arrangement as defined in claim 1, wherein said lever is articulated to said journal body at an articulation point and engaging at one side said cam means via a cam follower roller, and at another side a spring which bears upon said machine housing.

7. An arrangement as defined in claim 1, wherein said lever has an imaginary extension of said lever longitudinal axis intersecting the axis of said spindle shaft, and extending normal to a line connecting the pivot axis of said journal body and the axis of said spindle shaft which are spaced from one another by a predetermined distance.

8. An arrangement as defined in claim 1, and further comprising a measuring and heating element inserted into said lever for supervising the length of the lever and the position of a longitudinal center axis thereof.

9. An arrangement as defined in claim 1, wherein said journal body has a pivot axis defined by a torsion shaft.

10. An arrangement as defined in claim 1, and further comprising a drive gear mounted on a pivot axis of said journal body, and an output gear meshing with said drive gear and mounted on said spindle shaft.

* * * * *